United States Patent [19]

Kuroiwa et al.

[11] 4,425,886

[45] Jan. 17, 1984

[54] ELECTRONIC CONTROL APPARATUS FOR INTERNAL COMBUSTION ENGINE

[75] Inventors: Hiroshi Kuroiwa, Hitachi; Yoshishige Oyama, Katsuta, both of Japan

[73] Assignee: Hitachi, Ltd., Tokyo, Japan

[21] Appl. No.: 202,693

[22] Filed: Oct. 31, 1980

[30] Foreign Application Priority Data

Nov. 2, 1979 [JP] Japan ..... 54-141247

[51] Int. Cl.[3] ..... F02D 33/00

[52] U.S. Cl. ..... 123/339; 123/585; 123/587; 123/588

[58] Field of Search ..... 123/588, 585, 587, 589, 123/327, 339, 328

[56] References Cited

U.S. PATENT DOCUMENTS 3,964,457 6/1976 Coscia ..... 123/588
4,084,563 4/1978 Hattori et al. ..... 123/589
4,106,451 8/1978 Hattori et al. ..... 123/588
4,237,838 12/1980 Kinugawa et al. ..... 123/587

FOREIGN PATENT DOCUMENTS 54-113726 9/1979 Japan ..... 123/585

*Primary Examiner*—Andrew M. Dolinar
*Attorney, Agent, or Firm*—Antonelli, Terry & Wands

[57] ABSTRACT

An electronic control apparatus for an internal combustion engine monitors suction air concentration and an engine operation condition, and applies these values to a control circuit to produce output signals to control the air-fuel mixture to be supplied to the engine. The control circuit calculates a desired mass air flow rate based on at least one parameter representing an operating condition of the engine when the throttle valve is fully closed and controls the actual mass air flow rate bring it the desired mass air flow rate.

19 Claims, 19 Drawing Figures

ELECTRONIC CONTROL APPARATUS FOR INTERNAL COMBUSTION ENGINE

FIELD OF THE INVENTION

The present invention relates to an electronic control apparatus for an internal combustion engine, and more particularly to a control apparatus for controlling an internal combustion engine by digital arithmetic operations carried out by a central processing unit (CPU).

BACKGROUND OF THE INVENTION

As is well known, in an internal combustion engine, when the opening of a throttle valve is fixed, the mass air amount drawn into the engine decreases as the air density at the upstream of the venturi decreases, and the idling rotation speed of the engine decreases accordingly. In order to maintain a preset idling rotation speed, it has been proposed to detect the idling rotation speed and control the throttle valve or a valve in a bypass path near the throttle valve such that the actual idling rotation speed is brought to the preset rotation speed. An example of this approach is disclosed in U.S. Pat. No. 3,964,457 in which the difference between the actual idle speed of the engine and a target value for the idle speed determined by the engine temperature is determined and the suction air amount to the engine is controlled such that the difference is brought to zero.

This method is effective when the idling operation continues for a certain time period, but in a transient state from an operation range of a certain speed to the idling operation, this method cannot smoothly set the idling rotation speed.

As is well known, in a high suction vacuum condition such as idling operation, the pressure upstream of the throttle valve is close to atmospheric pressure while the vacuum downstream of the throttle valve is relatively high, so that the difference between the pressures upstream and downstream of the throttle valve is very large and substantially constant and the air flow velocity through the throttle valve is approximately equal to the velocity of sound. Accordingly, the suction air flow rate is uniquely determined by the opening of the throttle valve. FIG. 1 shows a graph of engine rotation speed N versus fuel flow rate $G_f$ when the opening is fixed at a certain value in such an operation range. For example, when the throttle opening is fixed at a selected angle (e.g. $\theta_1$) and the air flow rate (mass air flow rate) $G_a$ is fixed at a constant value $G_{al}$, the engine rotation speed N increases as the fuel flow rate $G_f$ gradually increases. However, from a critical value of $G_f$, N tends to decrease as $G_f$ increases. Usually, the air-fuel ratio (hereinafter referred to A/F) at or near the critical $G_f$ value falls within an area ranging from a stoichiometric A/F shown by a dot-and-dashed line 36 to A/F in a power zone. In a conventional engine, A/F is set at or near the stoichiometric A/F line. For example, it may be set on the A/F line shown by a broken line 38 in FIG. 1. When the operation range before deceleration is at a point $n_1$, the throttle valve opening is changed (reduced) in the deceleration operation by an angle corresponding to the difference between the current engine rotation speed $n_1$ and a reference engine crankshaft rotation speed $n_s$, so that the engine rotation speed is brought to the reference engine rotation speed $n_s$ (which is a target value for the idling rotation speed). The throttle valve opening is thus controlled such that the air flow rate becomes $Ga_1$, which causes the engine crankshaft rotation speed to be brought to the reference rotation speed $n_s$ at the current fuel flow rate. As a result, the air flow rate to the engine instantly settles to the value $G_{al}$ (that is, it moves to point $n_2$) in response to the change in the throttle valve opening, because no inertia delay to the change in the throttle valve opening is included, and the engine crankshaft rotation speed is brought to the target value $n_s$. However, the fuel flow rate to the engine does not change with a rapid response because of an inertia delay to the change in the throttle valve opening and transport delay due to the deposition of fuel on the inner wall of the suction manifold, but it gradually changes (decreases) toward the reference A/F, and the engine crankshaft rotation speed finally reaches point $n_3$. Thus, a difference of $n_2-n_3$ is caused in the engine rotation speed. Accordingly, the throttle valve is opened by an angle corresponding to this difference, in order to bring the difference to zero. As a result, the air flow rate instantly changes to $G_{a5}$ (point $n_4$ in FIG. 1) and the engine rotation speed changes to $n_s$. However, the fuel flow rate $G_f$ subsequently changes (increases) to the reference air-fuel ratio delayed relative to the change in the throttle valve opening so that the engine rotation speed changes to $n_5$, resulting in a difference of $n_5-n_s$ in the engine rotation speed. Thereafter, the engine rotation speed is controlled in a similar manner such that it changes from $n_5$ to $n_6$, $n_7$, $n_8$, $n_9$, $n_{10}$, . . . and finally converges to the reference rotation speed $n_s$. Thus, in the above method of setting the engine rotation speed to the reference rotation speed, hunting occurs, as shown in FIG. 2, in a transient operation and a long time period is required before the engine rotation speed converges to the reference speed. If the gain of the velocity feedback loop is increased so as to shorten the convergence time, the amplitude or velocity variation range of the hunting waveform shown in FIG. 2 increases. Accordingly, the feedback loop gain must be reduced to suppress the velocity variation. This results in a long convergence time to the reference engine rotation speed. This phenomenon occurs not only in the deceleration operation but also in the starting operation in which the engine operation is shifted from a cranking condition to the idling operation.

SUMMARY OF THE INVENTION

It is an object of the present invention to eliminate the difficulties encountered in the prior art.

In order to attain the above object, according to the present invention, when the throttle valve opening is small, a reference value for mass air flow rate to the engine is calculated based on at least one factor representing the operating condition of the engine and control is effected to bring the actual mass air flow rate to the reference value.

DETAILED DESCRIPTION OF THE PREFERRED EMBODIMENTS

Figure 3:
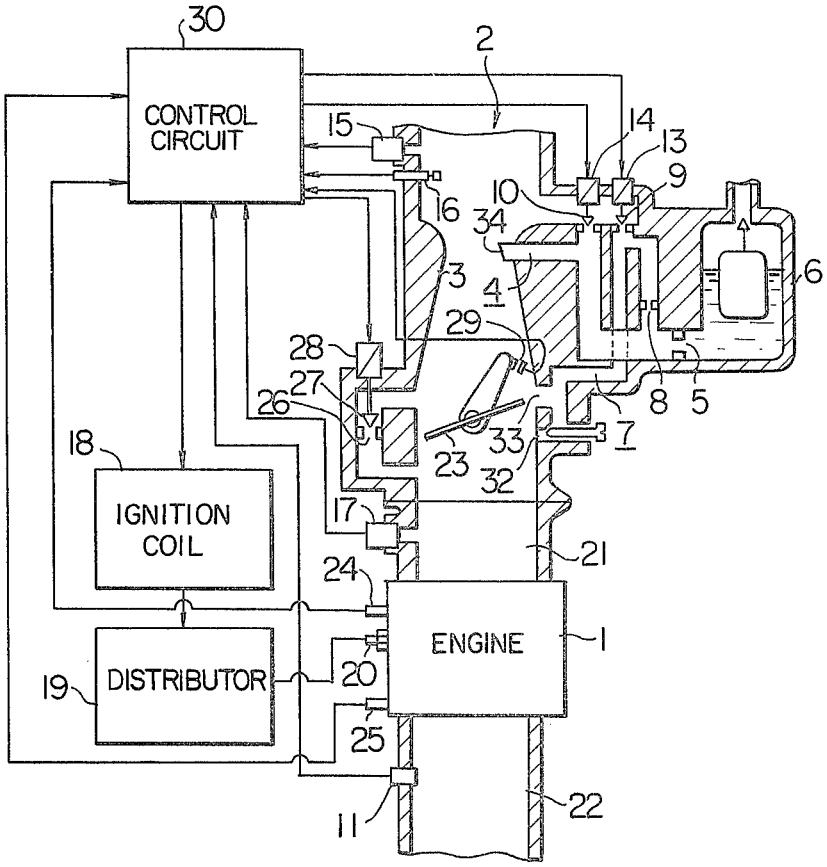
FIG. 3 shows a system diagram of one embodiment of an electronic control apparatus for an internal combustion engine according to the present invention.
Figure 2:
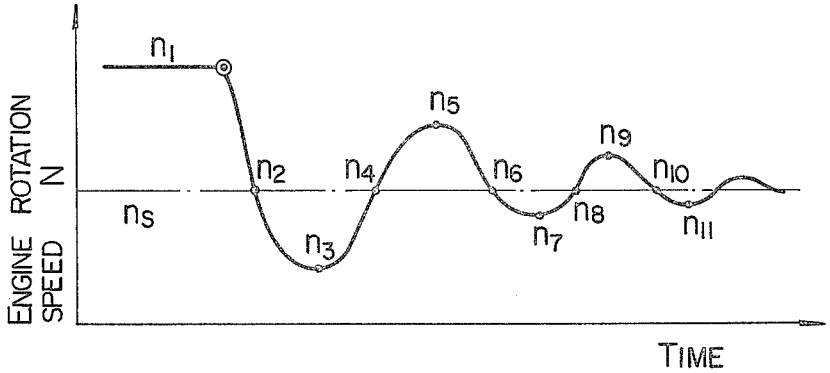

FIG. 3 shows a system diagram of one embodiment of the electronic control apparatus for an internal combustion engine in accordance with the present invention, in which the present invention is implemented in an internal combustion engine having a carburetor. In FIG. 3, the air-fuel mixture is supplied from a carburetor 2 to an engine 1 through a suction manifold 21. Numeral 22 denotes an exhaust manifold. The carburetor 2 comprises a float chamber 6, a throttle valve 23, a venturi 3, a main fuel channel 4 and a low speed fuel channel 7. In low speed operation (from idle operation to partial load operation), the fuel from the float chamber 6 is controlled by a main jet 5 and then fine-controlled by a slow jet 8, and mixed with air supplied from a slow air bleed 9, and the mixture is jetted to a suction path through an idle hole 32 formed downstream of the throttle valve 23 and a bypass hole 33 extending through an end of the throttle valve 23. In middle and high speed operations (from partial load operation to full load operation), the fuel controlled by the main jet 5 is mixed with air supplied from a main air bleed 10 and the mixture is jetted into the venturi 3 through a main nozzle 34 which opens into the venturi 3. The fuel flow rates of the main and low speed fuel channels may be controlled by changing opening areas of the main jet 5 and the slow jet 8, respectively, but in the present example the opening areas of the main air bleed 10 and the slow air bleed 9 are changed under the control of fuel control actuators 14 and 13, respectively. Disposed upstream of the venturi 3 is an atmospheric pressure sensor 15 for detecting atmospheric pressure, so as to produce a signal Pa indicative of the atmospheric pressure, and an air temperature sensor 16 which detects the temperature of the suction air to produce a signal $T_a$ representative of the temperature of the suction air. Disposed at the suction manifold is a suction air pressure sensor 17 which detects the suction air pressure to produce a signal $P_b$ representative of the suction air pressure. Numeral 27 denotes a valve disposed in a bypass path 26 which connects the upstream area of the throttle valve 23 to the downstream area. The valve 27 is driven by an air control actuator, e.g. a proportional solenoid 28. Provided at the engine 1 are a coolant temperature sensor 24 which detects the temperature of engine coolant, to produce a signal $T_w$ representative of the coolant temperature, and an angle sensor 25 which detects the rotational position of the crankshaft of the engine, to produce reference signals PR in synchronism with the rotation of the crankshaft, e.g. one signal for every 120 degrees rotation and angle signals $P_c$, one for every predetermined angle of rotation, e.g. once per revolution. Provided at the suction manifold 22 is an $O_2$sensor (λ-sensor) 11 which detects the oxygen concentration in the exhaust gas, to produce a siganl $V_\lambda$ representative of the oxygen concentration. The output signals of these sensors are supplied to a control circuit 30 where they are processed to produce control signals to drive the actuators 13, 14 and 28. The control circuit 30 also applies to an ignition coil 18 a signal to control firing of spark plugs 20 so that a high voltage generated across the ignition coil is applied to the spark plugs 20 through a distributor 19.

Figure 1:
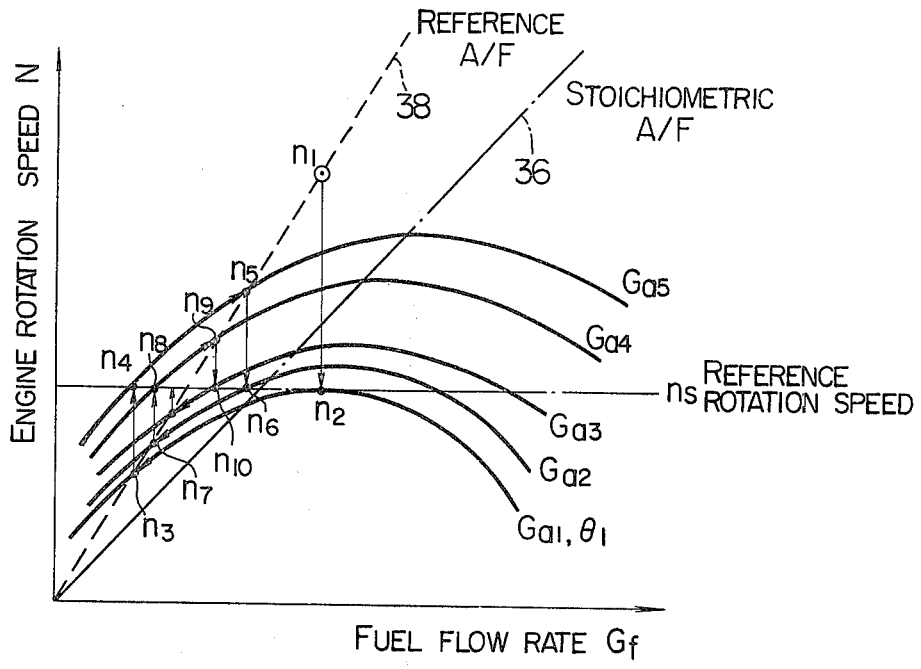
FIGS. 1 and 2 show conditions of the deceleration operation of a prior art electronic control apparatus for an internal combustion engine.
Figure 4:
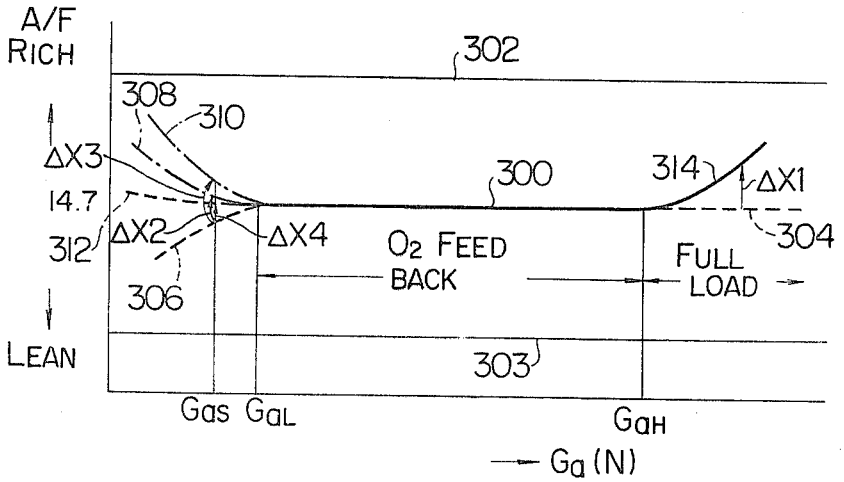
FIG. 4 shows the relationship between A/F and engine speed in various operating conditions.

Now, explanation will be presented of the A/F characteristic for various operation conditions of the engine referring to FIG. 4. In FIG. 4, lines 302, 300 and 303 show cases where the air bleeds 9 and 10 are fully closed, half opened and fully opened respectively.

In the normal operation range (partial load operation), the oxygen concentration in the exhaust gas is detected by the $O_2$ sensor and the detected signal is applied to the control circuit 30 which controls the actuator 28 to make the difference between a reference air flow rate and the actual air flow rate equal to zero and also controls the actuators 13 and 14 to make the difference between a reference fuel flow rate and the actual fuel flow rate equal to zero. In other words, they are controlled such that the mixture supplied from the carburetor 2 is equal to the stoichiometric A/F (i.e. 14.7) as shown by the line 300 in FIG. 4. In this manner, a so-called feedback control of A/F is carried out. In this operation range, the stoichiometric A/F can be correctly controlled even if the atmospheric pressure or the suction air temperature changes to cause a change in the density of the suction air. The $O_2$ sensor does not operate well in the operation range in which the exhaust gas temperature is low, e.g. in the warming-up operation range. This operation range is detected by a coolant temperature sensor to thereby cut off the feedback control of the $O_2$ sensor and makes the A/F richer than the stoichiometric A/F, as shown by dot-and-dashed lines 308, 310 in FIG. 4. In the idle operation range and the full load range (e.g. rapid acceleration or slope climbing operation range) an A/F richer than the stoichimetric A/F is required. In this case, the feedback control by the $O_2$ sensor is again cut off. The detection of the former operation range is effected by a small throttle valve opening switch 29 while the detection of the latter operation range is effected by a power switch or a large throttle valve opening switch (not shown).

Air—fuel ratios in the idle operation and the full load operation are shown by dot-and-dashed lines 312 and 314 in FIG. 4, respectively. In the deceleration operation range, feedback control by the $O_2$ sensor is again cut off and the detection of such an operation range is effected by the closure of the small throttle valve opening switch 29 and an engine rotation speed of a predetermined speed or higher.

Figure 5:
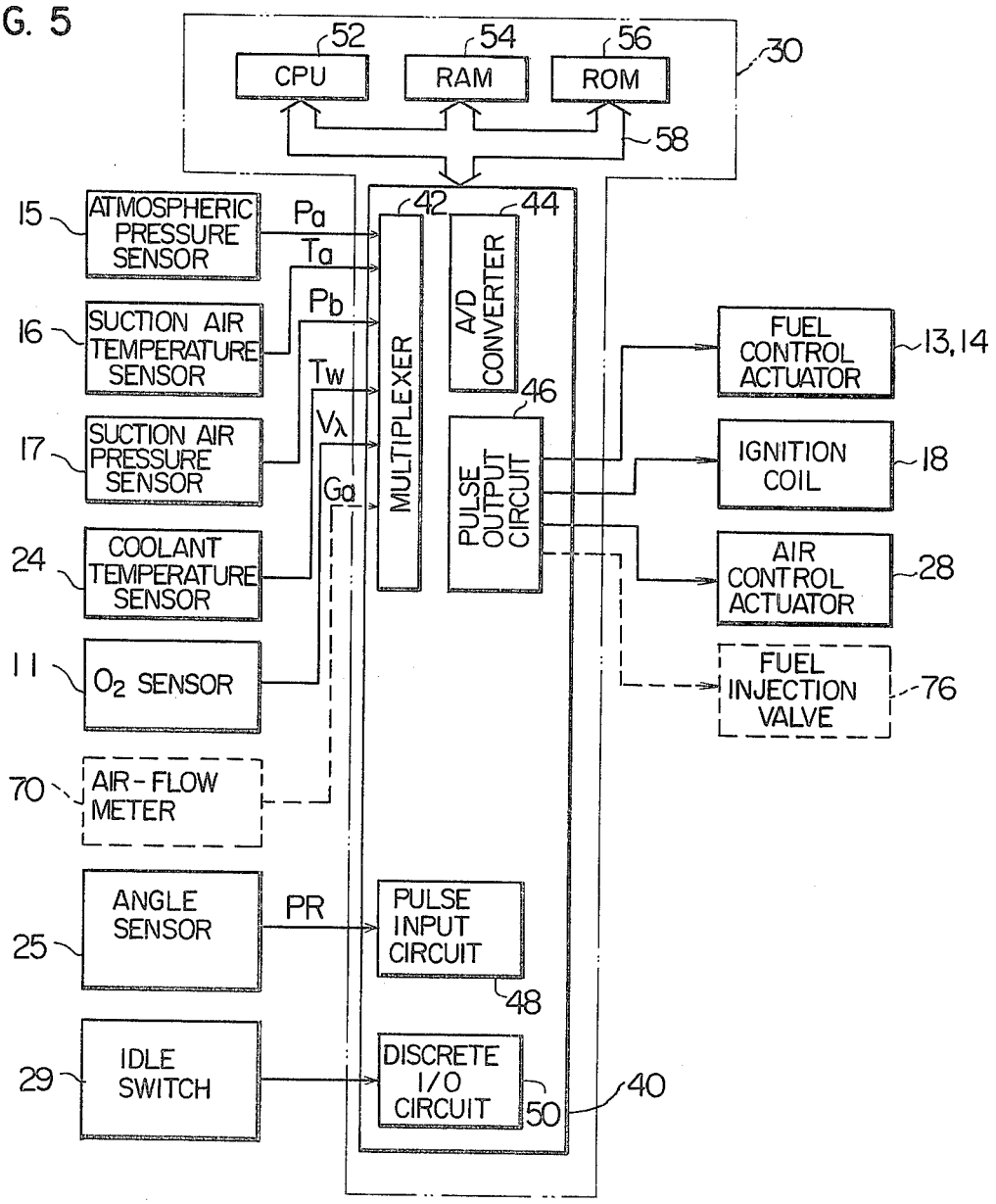
FIG. 5 shows a block diagram of a control circuit of the electronic control apparatus shown in FIG. 3.

A detailed circuit configuration of the control circuit 30 is shown in FIG. 5. The control circuit 30 comprises a central processing unit (CPU) 52, a random acces memory (RAM) 54, a read-only memory (ROM) 56 and an I/O circuit 40. The I/O circuit 40 includes a multiplexer 42, a pulse output circuit 46, a pulse input circuit 48 and a discrete I/O circuit 50. The multiplexer 42 receives analog input signals and selects one of the input signals by a command from the CPU 52. The selected input signal is applied to an analog-to-digital (A/D) converter 44. The analog input signals include the output signals of the sensors shown in FIG. 3, that is, an atmospheric pressure signal $P_a$ from an atmospheric pressure sensor 15, a suction air temperature signal $T_a$ from a suction air temperature sensor 16, the suction air pressure signal $P_b$ from a suction air pressure sensor 17, a coolant temperature signal $T_w$ from a coolant temperature sensor 24 and an oxygen concentration signal $V_\lambda$ in the exhaust gas from the $O_2$ sensor 11.

The CPU 52, the RAM 54, the ROM 56 and the I/O circuit 40 are interconnected by a data bus, an address bus and a control bus 58. Based on an instruction program stored in the ROM 56, the CPU 52 specifies an address via the address bus, so that the addressed analog input signal is coupled to the I/O circuit 40. The analog input signal is then sent to the multiplexer 42, thence to the A/D converter 44 and the digital-converted data are retained in the corresponding registers, which are read out to the CPU 52 or the RAM 54 by the instruction which is provided from the CPU 52 via the control bus.

The pulse input circuit 48 receives a reference pulse PR in the form of a pulse train from the angle sensor 25. The signals processed by the CPU 52 are retained in the pulse output circuit 46. The output signals from the pulse output circuit 46 are applied to the actuators 13 and 14, the ignition coil 18 and the proportional solenoid 28 to control the openings of the air bleeds 9 and 10, a primary coil current of the ignition coil 18 and the opening of the valve 27 in response to the output pulses. The discrete I/O circuit 50 receives signals from the idle switch 29 which detects the small opening condition of the throttle valve 23 and a power switch (not shown) which detects the large opening condition of the throttle valve 23, and retains them. The signals retained in the discrete I/O circuit 50 are processed by the CPU 52. The signals related to the discrete I/O circuit 50 can be identified by one bit.

Referring to a flow chart shown in FIG. 6, an example for controlling the carburetor shown in FIG. 3 at the stoichiometric air-fuel ratio will now be explained. A program for executing the flow chart is stored in the ROM 56 shown in FIG. 5.

Figure 7:
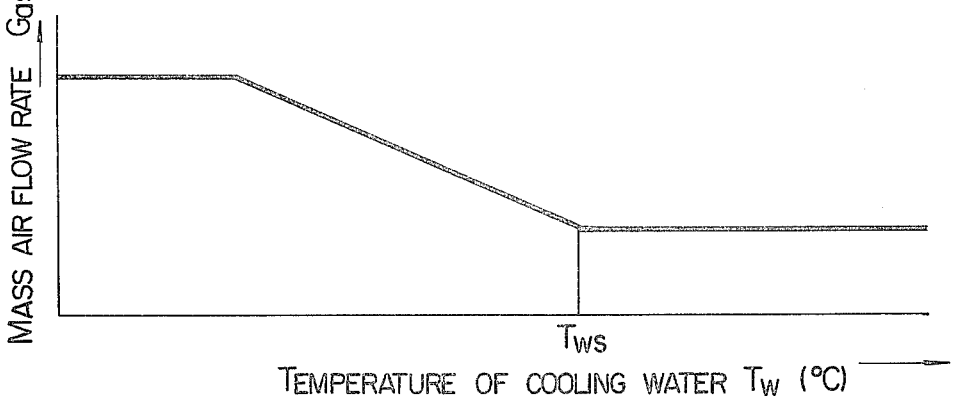
FIG. 7 shows the relationship between coolant temperature and reference mass air flow rate during idling.

First, the I/O circuit 40 reads in the engine coolant temperature signal $T_w$ from the coolant temperature sensor 24 (at step 100), and the detected coolant temperature signal $T_w$ is compared with a reference coolant temperature signal $T_{ws}$ which represents a warming-up completion condition (at step 102). When $T_w$ is smaller than $T_{ws}$, the atmospheric pressure signal $P_a$ and the suction air pressure signal $T_a$ are read in and those signals are processed in the CPU 52 in accordance with a calculation formula stored in the ROM 56 to determine air concentration $\gamma_a$ (at step 104). That is, $\gamma_a = f(P_a, T_a)$ is determined. This formula indicates that $P_a$ and $T_a$ are processed in accordance with a predetermined function to produce $\gamma_a$. The representation in the flow chart indicates the same thing. Then, the condition of the small throttle valve opening switch (idle switch) 29 is determined (at step 106). If the idle switch 29 is ON, the start/warming-up operation is determined and a reference mass air flow rate $G_{as}$ for the idling operation (a desired mass air flow rate to be fed into the engine during the idling operation) for at least one factor representing the operating condition of the engine, such as the coolant temperature $T_w$, is obtained (at step 108). It is obtained by retrieving the desired mass air flow rate $G_{as}$ in an idle operation for the coolant temperature $T_w$ from a coolant temperature-versus-reference mass air flow rate map, shown in FIG. 7, stored in the ROM 56. At step 114, the actual mass air flow rate $G_a$ in the present operation condition is calculated based upon the engine crankshaft rotation speed N, the suction air pressure $P_b$ and the air concentration $\gamma a$ which was determined in step 104. That is, $G_a = f(N, P_b, \gamma a)$ is calculated. The engine crankshaft rotation speed N is calculated by the CPU 52 based upon the reference signal PR.

When, the warming-up operation is determined at the step 106, a correction value $\Delta T_f$ for a fuel flow rate control signal to the actuators 13 and 14 corresponding to the temperature $T_w$ is read out of a map in the ROM (step 110). Namely, $\Delta T_f = f(T_w)$ is obtained. In FIG. 4, the dot-and-dashed lines 308, 310 show A/Fs in a warming-up operation where the line 310 shows a case when the temperature $T_w$ is lower than a case of the line 306. A dotted line 306 shows a case where no correction signal is applied to the actuators 13 and 14 during the idling operation. In the step 110, a correction value $\Delta T_f$ corresponding to a correction value of A/F such as $\Delta\times 2$ or $\Delta\times 3$ in FIG. 4 is obtained. At step 112, the correction value $\Delta T_f$ is applied to the actuators 13 and 14. At step 116, the difference $\Delta G_a = G_a - G_{as}$ is calculated based on the air flow rates $G_{as}$ and $G_a$ determined at the steps 108 and 114. It is then determined if $\Delta G_a$ is zero or not (at step 118). If $G_a$ is zero (step 120), a correction value $\Delta T_a$ for an air flow rate control signal $T_a$ to the air control actuator (proportional solenoid) 28 is zero and the air flow rate control signal $T_a$ is sent out without correction, thereby controlling the actual air flow rate to the value $G_{as}$ (at step 123). If $G_a$ is not zero, the correction value $\Delta T_a$ for the air flow rate control signal $T_a$ to the actuator 28 is calculated based on the difference $G_a[\Delta T_a = f(G_a - G_{as})]$ (at a step 122), and the correction value $\Delta T_a$ is added to the original control signal $T_a$ thereby controlling the actual air flow rate to the value $G_{as}$ (at step 123).

If it is determined that the idle switch 29 is OFF at the step 106, it is determined that the operation condition is normal and the process proceeds to step 124. At the step 124, a correction value $\Delta T_f$ for the actuators 13 and 14 corresponding to the temperature $T_w$ is read out of a map in the ROM and applied to the actuators at step 126, to thereby make the A/F in this case richer than the stoichiometric A/F in correspondence with the temperature $T_w$.

If it is determined at the step 102 that the coolant temperature $T_w$ is higher than the reference coolant temperature $T_{ws}$, the air concentration $\gamma_a$ of the suction air is calculated at step 130 in the same manner as in the step 104. At step 132, the closure of the idle switch 29 is examined. If the idle switch in not ON, the on-off state of a power switch is checked at step 134, that is, it is determined if the opening of the throttle valve 23 has reached a necessary opening corresponding to the power operation range. If the power switch is OFF, it is detemined that the operation condition is not a full load operation but a partial load operation and at step 136 the feedback control for the air-fuel ratio is effected based on the output signal of the $O_2$ sensor. If the power switch is ON, it is determined that the operation condition is a full load operation, and at step 138 the engine crankshaft rotation speed N is read out and a correction value $\Delta T_f$ corresponding to the speed N is read out of a map in the ROM or calculated. The correction value $\Delta T_f$ is applied to the actuators 13 and 14 at step 140. Namely, in the full load operation, where the air flow rate is larger than a pregiven value $G_{AH}$, it is desirable to make A/F richer than the stoichiometric A/F by a value $\Delta X1$ in correspondence with the speed N, or a mass air flow rate $G_a$, as shown by a dot-and-dashed line 314. Now, in the step 138, the correction value $\Delta T_f$ may be obtained in accordance with a mass air flow rate $G_a$.

If it is determined at the step 132 that the idle switch 29 is ON, a correction value $\Delta T_f$ stored in the ROM is read out at step 144. As shown in FIG. 4, in an area where the idle switch 29 is ON and the air flow rate is lower than a predetermined value such as $G_{aL}$, the A/F becomes more lean than the stoichiometric A/F with the decrease of the air flow rate $G_a$ as shown by the dotted line 306 due to the mechanical error or characteristics of the throttle valve. Thus, at the reference idle mass air flow rate $G_{as}$ during idling, there is a difference $\Delta\times4$ between the actual A/F and the desired A/F shown by a dotted line 312. The correction value $\Delta T_f$ obtained in this step corresponds to the difference $\Delta\times4$.

The correction value $\Delta T_f$ is applied to the actuators 13 and 14 thereby controlling the A/F to be a desired value.

At step 146, the reference idle mass air flow rate $G_{as}$ stored in the ROM is read out. At step 148, the actual mass air flow rate $G_a$ in the present operation condition is calculated based on the engine crankshaft rotation speed N, the suction air pressure $P_b$ and the air concentration $\gamma_a$ determined at the step 130. That is, $G_a=f(N, P_b, \gamma_a)$ is calculated. The engine crankshaft rotation speed N is calculated by the CPU 52 based on the reference signal PR. At step 150, the difference $\Delta G_a=G_a-G_{as}$ is calculated based on the air flow rates $G_a$ and $G_{as}$ determined at the steps 144 and 148. It is determined if $G_a$ is zero or not (at step 152). If $G_a$ is zero, a correction value $\Delta T_a$ for the air flow rate control signal $T_a$ to the air control actuators (proportional solenoid) 28 is zero, and the air flow rate control signal $T_a$ is sent out without correction (at step 154). When $\Delta G_a$ is not zero, a correction value $\Delta T_a$ for the control signal $T_a$ to the actuator 28 is calculated based on the difference $G_a[\Delta T_a=f(G_a-G_{as})]$, and $\Delta T_a$ is added to the original air flow rate control signal $T_a$ (at step 156).

The above flow chart shows a mere example and the air flow rate and the fuel flow rate may be controlled by other methods.

As described above, since the optimum mass air flow rate $G_{as}$ is set when the throttle valve 23 is in the closed condition and the actual air flow rate $G_a$ is controlled to approach $G_{as}$, the air-fuel ratio can be controlled to be the optimum ratio. Furthermore, by feedback controlling the air flow rate and the fuel flow rate supplied to the engine such that the actual mass air flow rate is brought to the reference mass air flow rate, the air-fuel ratio can be controlled to the desired ratio even in the operation range in which no feedback control by the $O_2$ sensor is effected, such as for the start/warm-up operation range, the idling operation range and the power operation range. In addition, the change in the mass air flow rate relative to the change in the atmospheric concentration is eliminated and a proper air-fuel ratio is attained while maintaining a proper idling rotation speed.

Figure 9:
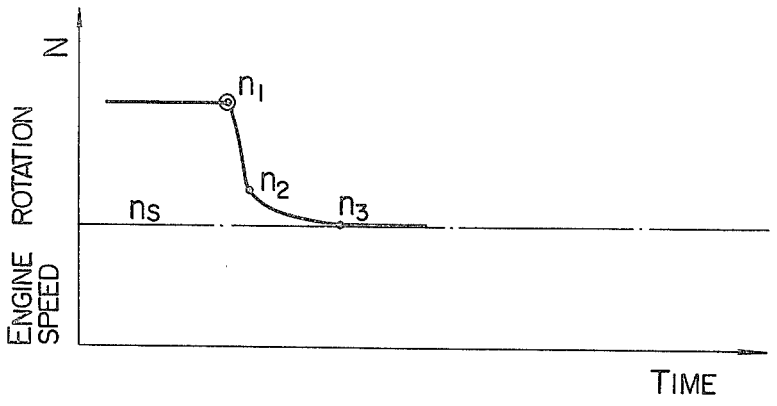
FIGS. 8 and 9 show conditions of the deceleration operation of the electronic control apparatus for an internal combustion engine according to the present invention.
Figure 8:
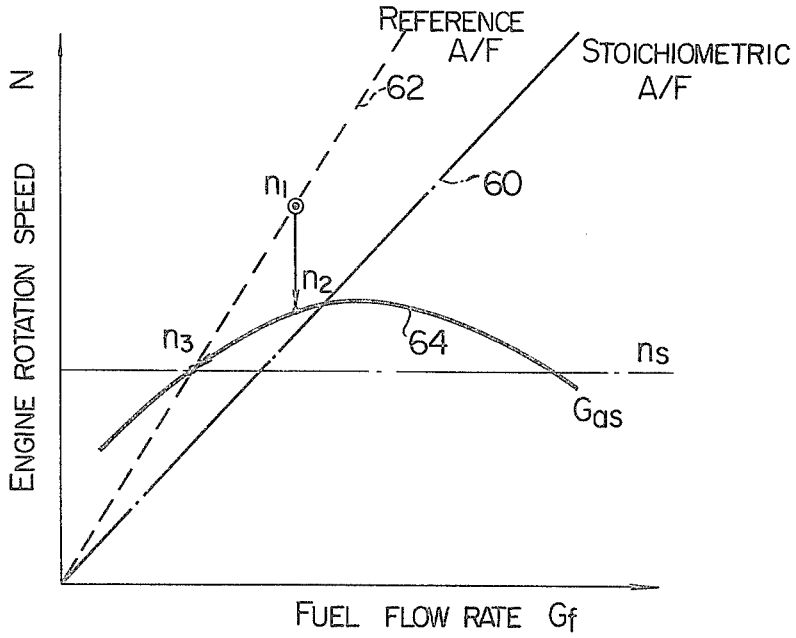

Furthermore, in the deceleration operation in which the operation condition at a certain speed is shifted to the idling operation, hunting of the engine crankshaft rotation speed is prevented and the operation can be rapidly shifted to the idling operation. The reason therefor will be explained with reference to FIGS. 8 and 9 for the deceleration operation. In FIG. 8, the dot-and-dashed line 60 indicates the stoichiometric air-fuel ratio. Assume that the engine condition is set at the air-fuel ratio shown by a broken line 62. The solid line 64 shows a change of the engine crankshaft rotation speed N at the fuel flow rate $G_f$ when the air flow rate is set at the idling value $G_{as}$. When the operation range before deceleration is at a point $n_1$, the valve 27 in the bypass path 26 and/or the throttle valve 23 are controlled such that when deceleration occurs, that is, when the accelerator pedal is released, the mass air flow rate into the engine is brought to the idling reference air flow rate $G_{as}$. Then, the air flow rate into the engine instantly changes to $G_{as}$ and the operation condition instantly changes to a point $n_2$ and the engine rotation speed changes to $n_2$. However, since the fuel flow rate $G_f$ into the engine changes, delayed with respect to to the change of the opening of the valve 27 in the bypass path or the throttle valve 23, it gradually decreases toward the reference air-fuel ratio and shifts to a point $n_3$ along the curve 64 and finally reaches the reference rotation speed $n_3$. Accordingly, the engine rotation speed changes with respect to time in a manner shown in FIG. 9. That is, it rapidly changes to the reference rotation speed without hunting.

Figure 6:
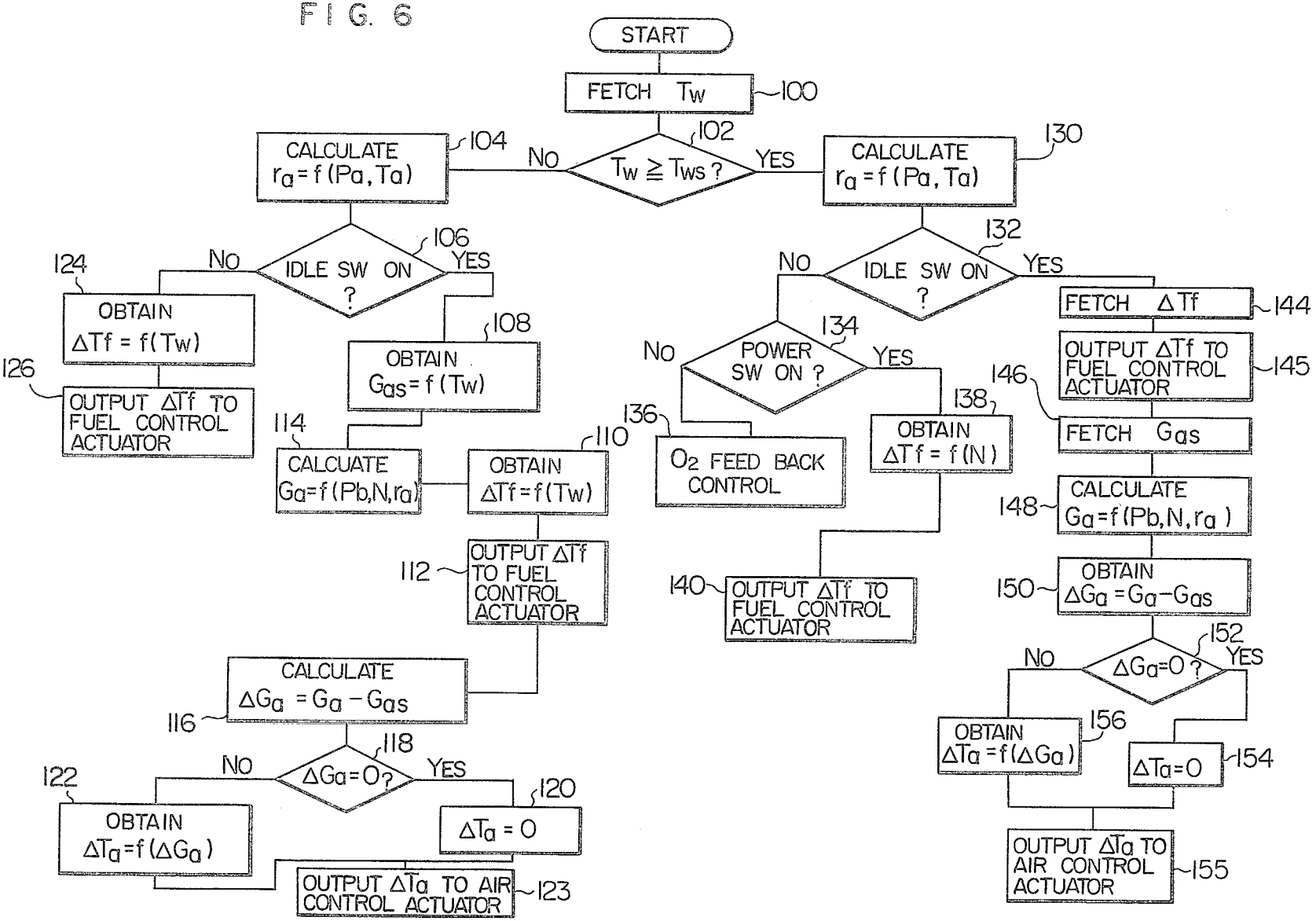
FIG. 6 shows a flow chart of a control method for controlling the engine in the embodiment shown in FIG. 3.

The control of the air flow rate in the deceleration operation corresponds to the steps 106–123 or the steps 132 and 144–156 in the flow chart of FIG. 6.

The shift operation from the cranking condition to the idling operation in the start operation is also effected smoothly in the similar steps without hunting.

Figure 10:
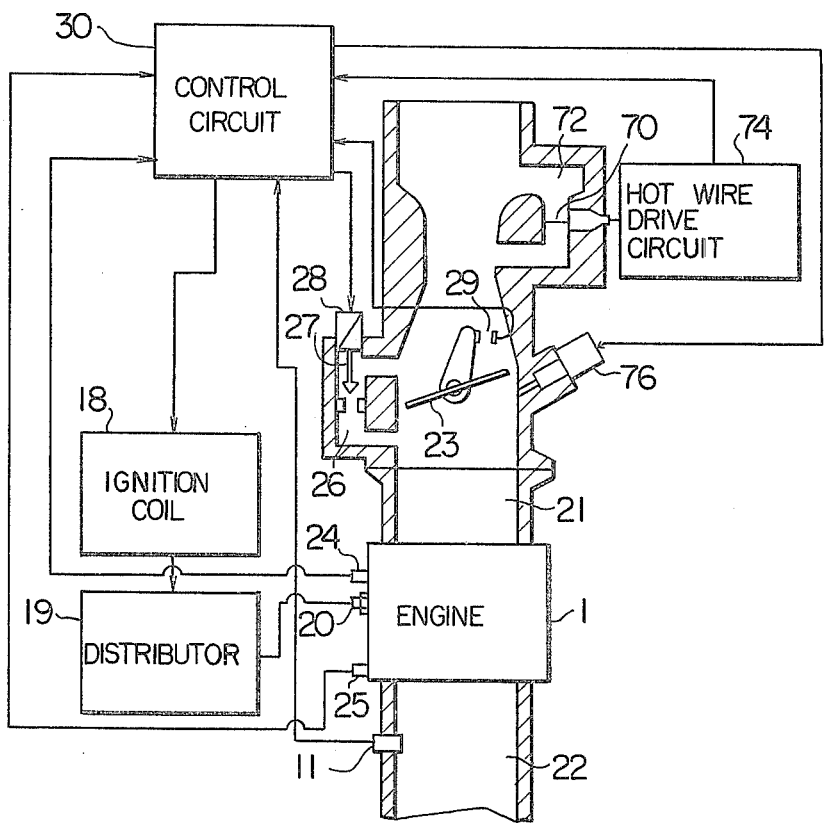
FIG. 10 shows a system diagram of another embodiment of the present invention in which the present invention is implemented in a throttle body injection type engine.

FIG. 10 shows a system diagram of an embodiment in which the present invention is implemented in a throttle-point (body) injection type engine. In the present embodiment, a single fuel injection valve 76 common to the cylinders is provided downstream of the throttle valve 23 in place of the main fuel channel 4 and the slow speed fuel channel 7 shown in FIG. 3. In FIG. 10, disposed upstream of the throttle valve 23 of the throttle chamber is an air path 72 in which a hot wire 70 is mounted. It is driven by a hot wire drive circuit 74. The hot wire 70 and the hot wire drive circuit 74 form a hot-wire type air-flow meter which produces an electrical signal which changes in response to the air flow rate determined by a relationship between the air flow rate and a thermal conduction of a heat generating element. The electrical signal is applied to the control circuit 30. By the use of the thermal air flow rate meter, the atmospheric pressure sensor 15 and the suction air pressure sensor 17 shown in FIG. 3 are not necessary and the correct mass air flow rate $G_a$ can be determined irrespective of the change in the atmospheric pressure and the suction air temperature. The fuel jet valve 206 is controlled by the fuel control signal $T_f$ from the control circuit 30. The relationship of the I/O signals to the control circuit 30 in the present embodiment is shown in FIG. 5.

The engine control method in the present embodiment is now explained with reference to a flow chart shown in FIG. 11.

Figure 11:
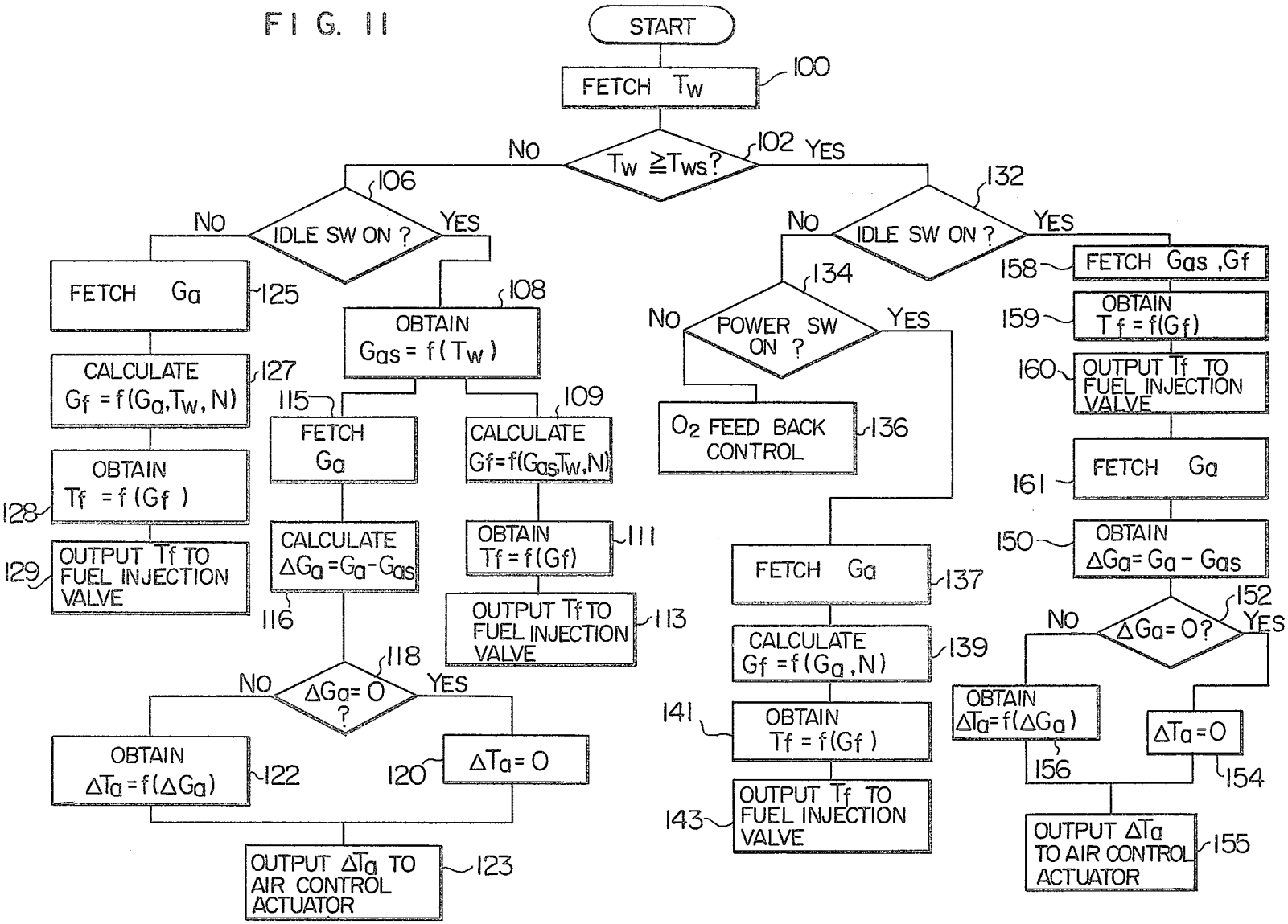
FIG. 11 shows a flow chart of a control method for the engine shown in the embodiment of FIG. 10.

In the flow chart shown in FIG. 11, those designated by the same numerals as those portions in FIG. 6 function in the same manner. The difference between the present embodiment an the flow chart shown in FIG. 6 is that the actual air flow rate $G_a$ is determined by the thermal air flow rate meter and hence it need not be calculated. Accordingly, the air flow rate need only be read from the thermal air-flow meter. The fuel flow rate control is effected by determining the fuel flow rate control signal $T_f$ in accordance with a desired fuel flow rate $G_f$ and applying it to the fuel injection valve 76.

First, the I/O circuit 40 reads in the engine coolant temperature signal $T_w$ from the coolant temperature sensor 24 (at step 100), and the detected coolant temperature signal $T_w$ is compared with a reference coolant temperature signal $T_{ws}$ which represents the warming-up completion condition (at step 102). When $T_w$ is smaller than $T_{ws}$, the condition of the small throttle valve opening switch (idle switch) 29 is determined (at step 106). If the idle switch 29 is ON, the start/warm-up operation is determind and a reference mass air flow rate $G_{as}$ for idling operation (a desired mass air flow rate to be fed into the engine in the idling operation) for the coolant temperature $T_w$ is obtained at step 108. The desired fuel flow rate $G_f$ is calculated based on the reference mass air flow rate $G_{as}$, the coolant temperature $T_w$ and the engine rotation speed N at step 109. That is, $G_f=f(G_{as}, T_w, N)$ is calculated. The engine rotation speed N is calculated by the CPU based on the reference signal PR. At step 111, a fuel control signal $T_f$ to the fuel injection valve 76 for the fuel flow rate $G_f$ is determined and applied to the fuel injection valve, thereby controlling the actual fuel flow rate to the value $G_f$ at a step 113. As step 115, an actual mass air flow rate $G_a$ in the present operation condition is read out of the air-flow meter 70.

At step 116, the difference $\Delta G_a=G_a-G_{as}$ is calculated based on the air flow rates $G_{as}$ and $G_a$ determined at the steps 108 and 115. It is then determined if $\Delta G_a$ is zero or not (at step 118). If $G_a$ is zero, a correction value $\Delta T_a$ for the air flow rate control signal $T_a$ to the air control actuator (proportional solenoid) 28 is zero (step 120) and the air flow rate control signal $T_a$ is sent out without correction (at step 123). If $G_a$ is not zero, the correction value $\Delta T_a$ for the air flow rate control signal $T_a$ to the actuator 28 is calculated based on the difference $Ga[\Delta T_a=f(G_a-G_{as})]$ (step 122), and the correction value $\Delta T_a$ is added to the original control signal $T_a$ (at step 123).

If it is determined that the idle switch 29 is OFF at the step 106, it is determined that the operation condition is not the idle operation and the process proceeds to step 125. At the step 125, the actual air flow rate $G_a$ is read out of the air flow meter 70. At step 127, the desired fuel flow rate $G_f$ is calculated based on the air flow rate $G_a$, the coolant water temperature $T_w$ and the engine rotation speed N. A fuel control signal $T_f$ to the fuel flow rate $G_f$ is calculated or read out of a map in the ROM at step 128 and applied to the fuel injection valve 76 at step 129 thereby controlling the actual fuel flow rate to the value $G_f$.

If it is determined at the step 102 that the coolant temperture $T_w$ is higher than the reference coolant temperature $T_{ws}$, the closure of the idle switch 29 is examined at step 132. If the idle switch is not ON, the on-off state of a power switch is checked at step 134, that is; it is determined if the opening of the throttle valve 23 has reached a necessary opening corresponding to the full load operation. If the power switch is OFF, it is determined that the operation condition is the partial load operation and at step 136 the feedback control for the air-fuel ratio is effected based on the output signal of the $O_2$ sensor. If the power switch is ON, it is determined that the operation condition is a full load operation and, at step 137, actual air flow rate $G_a$ is read out of the air flow meter 70. At step 139, the fuel flow rate $G_f$ to be supplied is calculated based on the air flow rate $G_a$ and the engine rotation speed N, and at step 141 a fuel control signal $T_f$ to the fuel injection valve 76 is calculated based on $G_f$ and it is applied to the fuel injection valve 76 at step 143, thereby controlling the actual fuel flow rate to the value $G_f$.

If it is determined at the step 132 that the idle switch 29 is ON, a reference idle mass air flow rate $G_{as}$ stored in the ROM 56 and a fuel flow rate $G_f$ for the reference mass air flow rate $G_{as}$ are read out (at step 158). Alternatively, the fuel flow rate $G_f$ may be determined by the mass air flow rate $G_{as}$ in accordance with a predetermined calculation formula. At step 159, a fuel control signal $T_f$ to the fuel injection valve 76 for the fuel flow rate $G_f$ determined at the step 158 is determined and applied to the fuel injection valve at step 160. At step 161, the actual mass air flow rate $G_a$ in the present operation condition is read out of the air flow meter 70.

At step 150, the difference $\Delta G_a=G_a-G_{as}$ is calculated based on the air flow rates $G_a$ and $G_{as}$ determined at the steps 158 and 161. It is determined if $G_a$ is zero or not (at step 152). If $G_a$ is zero, a correction value $\Delta T_a$ for the air flow rate control signal $T_a$ to the air control actuators (proportional solenoid) 28 is zero (at step 154), and the air flow rate control signal $T_a$ is sent out without correction, thereby controlling the actual air flow rate to the value $G_{as}$ (at step 155). When $\Delta G_a$ is not zero, a correction value $\Delta T_a$ for the control signal $T_a$ to the actuator 28 is calculated based on the difference $G_a[\Delta T_a=f(G_a-G_{as})]$ (at step 156), and $\Delta T_a$ is added to the original air flow rate control signal $T_a$ and applied to the actuator 28, thereby controlling the actual air flow rate to the value $G_{as}$.

The above flow chart shows a mere example and the air flow rate and the fuel flow rate may be controlled by other methods.

The effect of the present embodiment is same as that of the embodiment of FIG. 3. That is, hunting is prevented in the deceleration operation, the engine is properly controlled irrespective of the change in the atmospheric air concentration and the suction air temperature, and the air-fuel ratio is controlled to an optimum ratio even in the operation range in which the $O_2$ sensor does not operate.

In the embodiments shown in FIGS. 3 and 10, the valve 27 is provided in the bypass path 26 and it is driven by the proportional solenoid 28 to control the air flow rate. Modifications of the control apparatus for the air flow rate into the engine will now be explained with reference to FIGS. 12 to 17.

Figure 12:
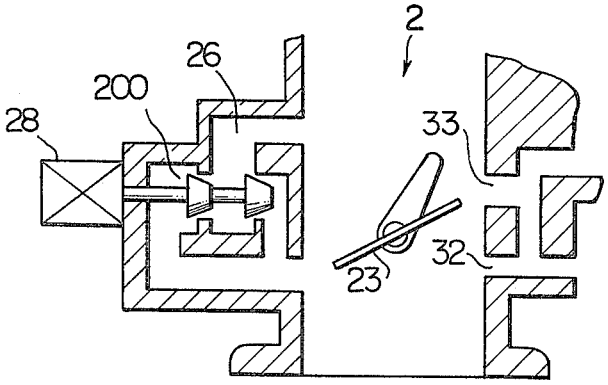
FIGS. 12 to 17 show modifications of the air flow rate controller shown in the embodiments of FIGS. 3 and 10.

FIG. 12 shows a sectional view of the throttle valve 23 and the associated elements for the carburetor 2 and it shows a first modification of the air flow rate control apparatus. A double-seat valve 200 is disposed intermediate the bypass path 26 connecting the upstream area of the throttle valve 23 to the downstream area to take place of the valve 27 shown in FIG. 3. The double-seat valve 200 is driven by the proportioal solenoid 28 to change stroke, so that the bypass path sectional area is controlled to adjust the suction air flow rate. The double-seat valve 200 is used in order to eliminate the effect of the magnitude of the suction vacuum downstream of the throttle valve 23 to the driving power of the valve 27, so that the bypass air flow rate is controlled only by the driving power of the proportional solenoid 28.

Figure 13A:
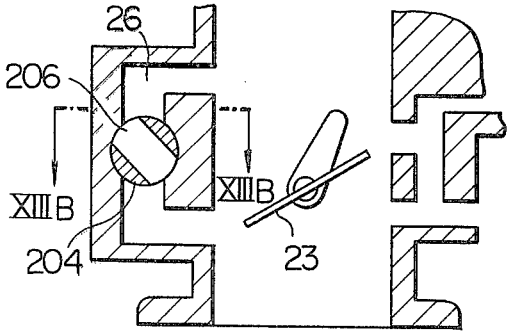
Figure 13B:
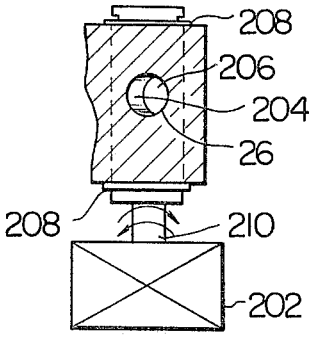

FIGS. 13A and 13B show a second modification of the air flow rate control apparatus. In the present embodiment, a stepping; motor 202 and a cock valve 204 are used to take place of the proportional solenoid 28 and the valve 27 shown in FIG. 3. In FIG. 13A, a cock valve 204 having a through-hole 206 is disposed in the bypass path 26 to take place of the valve 27 shown in FIG. 3. By rotating the valve 204, the cross-sectional area of a path connecting the through-hole 206 and the bypass path 26 is changed so that the bypass air flow rate is changed. FIG. 13B shows a sectional view taken along a line XIIIB—XIIIB shown in FIG. 13A. The cock valve 204 is mounted on a drive shaft 210 which is rotated clockwise or counterclockwise by the stepping motor 202. C-shaped rings 208 are fitted to the opposite ends of the drive shaft 210 to prevent the through-hole 206 of the cock valve 204 from moving lengthwise of the shaft 210 so that the air flow rate is correctly controlled even when a small amount of air passes therethrough. The precision of control can be further enhanced when a reduction gear mechanism is provided between the stepping motor 202 and the drive shaft 210.

The proportional solenoid 28 shown in FIG. 12 and the stepping motor 202 shown in FIG. 13B are controlled by the air flow rate control signal $T_a$ from the control circuit 30 shown in FIG. 3. The positions of the double-seat valve 200 and the cock valve 204 are controlled such that a proper idling rotation speed is obtained in response to the change in the suction air flow rate and the air concentration in order to maintain the proper idling rotation speed. This can provide a proper air flow rate to properly control the engine not only in the deceleration and acceleration operations but also in the fast idling operation for a cold start operation.

In the air flow rate control apparatus described above, the bypass path 26 is provided between the upstream area and the downstream area of the throttle valve 23 to control the air flow rate passing therethrough. Referring to FIGS. 14 to 17, an air flow rate control apparatus which controls the air flow rate by directly controlling the opening of the throttle valve 23 or the opening sectional area of the throttle chamber without using the bypass path will now be explained.

Figure 14:
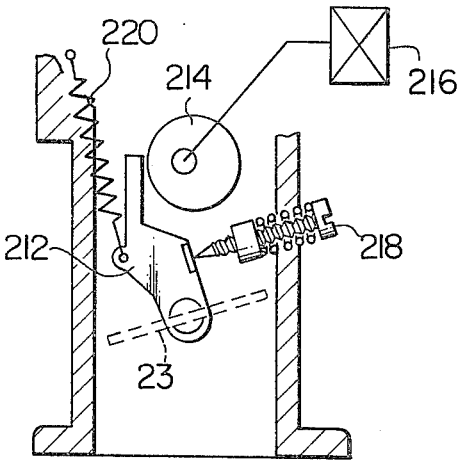

FIG. 14 shows a third embodiment of the air flow rate control apparatus, in which the opening of the throttle valve 23 is changed by a stepping motor 216 through a throttle lever 212 and an eccentric cam 214. In the present embodiment, the idling air flow rate in the normal atmospheric air condition is adjusted by an idling adjusting screw 218. The stepping motor output 216 is rotated by a predetermined angle in response to the air flow-rate control signal from the control circuit 30, so that the eccentric cam 214 is rotated to move the throttle lever 212. Accordingly, the opening of the throttle valve 23 is changed to provide a proper air flow rate. A return spring 220 functions to keep constant contact between an end plane of the eccentric cam 214 and the throttle lever 212.

Figure 15:
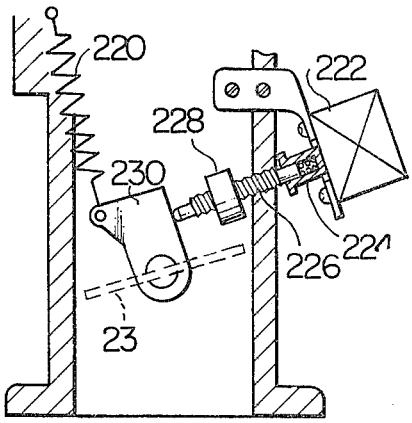

FIG. 15 shows a fourth modification of the air flow rate control apparatus. Connected to a drive shaft 224 of a stepping motor 222 is one end of a screw 226 which threadedly engages with a stationary female screw member 228. As a result, when the air flow rate control signal $T_a$ is applied to the stepping motor 222 to rotate the same in the forward or backward direction, the screw 226 moves forward or backward to rotate the throttle lever 230 which in turn changes the opening of the throttle valve 23. When a reduction gear mechanism is attached to the stepping motor 222, the precision of the control of the opening of the throttle valve 23 is enhanced, as in the previous case.

When the opening of the throttle valve is controlled by the stepping motor 216 or 222 as shown in FIGS. 14 and 15, the precision of the control is descreased if axial movement of the throttle valve shaft exists. In order to prevent such movement, a C-shaped ring 208 is provided, as in the case of the cock valve shaft 210 shown in FIGS. 13A and 13B.

Figure 16A:
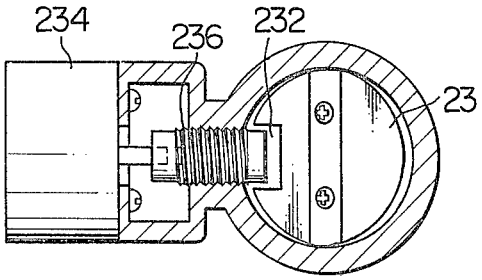
Figure 16B:
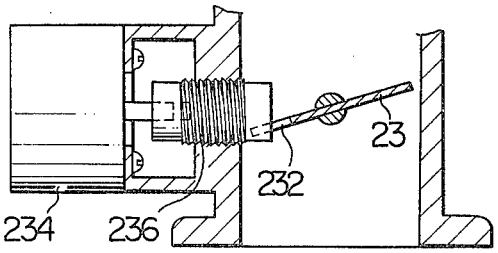

FIG. 16A shows a fifth modification of the air flow rate control apparatus and FIG. 16B shows a sectional view thereof. In the present embodiment, a cut-out 232 is formed in the throttle valve 23 and the opening area of the cut-out 232 is changed by the head of a screw 236 which translates the rotation of a stepping motor 234 to a linear movement in order to control the suction air flow rate.

Figure 17:
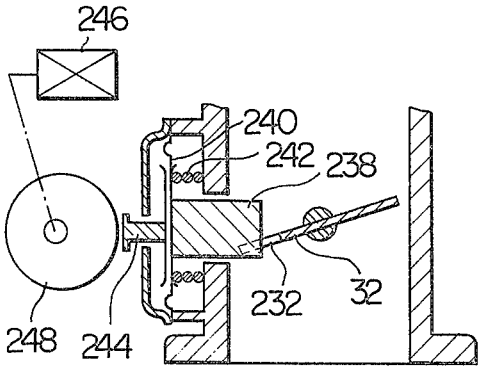

FIG. 17 shows a sixth modification of the air flow rate control apparatus, which is an improvement over the fifth modification. The screw 236 fitted to the cut-out of the throttle valve 23 shown in FIGS. 16A and 16B produces a backlash axially of the rotating shaft of the stepping motor and hence the precision tends to be lowered. In the present embodiment, in order to overcome the above difficulty, a piston 238 is fixed to a center of a diaphragm 240 which is spring-biased by a spring 242 to pull out the piston 238 leftward as viewed in the drawing. On the other hand, a lead shaft 244 fixed to the left end of the diaphragm 240 is kept in constant contact with a cam surface of an eccentric cam 248 which is rotated by the stepping motor 246. As a result, when the stepping motor 246 is driven by the air flow rate control signal $T_a$, the piston 238 is moved leftward or rightward by a distance corresponding to the differential height of the cam surface, to adjust the opening area of the cut-out 232 of the throttle valve 23. Accordingly, the precision of the control of the air flow rate is enhanced.

As described hereinabove, according to the present invention, a desired value of the air flow rate which is determined by the coolant temperature is set in the idling operation, that is, in the closed state of the throttle valve and the feedback control is effected to bring the actual mass air flow rate to the desired valve. Accordingly, hunting in the deceleration operation is prevented and the operation is rapidly shifted to the idling operation.

Furthermore, a predetermined mass air flow rate is provided in the start/warm-up operation, the power operation and the idling operation to attain a desired air-fuel ratio. In addition, the change in the mass air flow rate to the change in the atmospheric pressure is prevented to maintain the desired air-fuel ratio.

In the embodiment shown in FIG. 3, the atmospheric pressure sensor, the suction air temperature sensor and the suction air pressure sensor are used, and in the embodiment shown in FIG. 10 the hot wire is used to measure the mass air flow rate. It should be understood that other known elements may be used.

What is claimed is:

1. A method of controlling the air/fuel ratio of the air/fuel mixture supplied to an internal combustion engine comprising the steps of:

(a) measuring the actual mass air flow rate of the intake air flow to said engine;

(b) measuring at least one prescribed parameter representative of an operating condition of the engine;

(c) determining a desired mass air flow rate in accordance with the value of said at least one parameter measured in step (b); and (d) controlling the actual mass air flow rate of the intake air flow rate to said engine in accordance with the desired mass air flow rate determined in step (c), so that the actual mass air flow rate is caused to finally coincide with a mass air flow rate which has a prescribed relationship with the desired mass air flow rate.

2. A method according to claim 1, wherein said actual mass air flow rate is controlled in accordance with the difference between the actual mass air flow rate and the desired mass air flow rate.

3. A method according to claim 2, wherein step (d) comprises adjusting said actual mass air flow rates so as to reduce said difference to zero.

4. A method according to claim 1, wherein said at least one prescribed parameter includes the temperature of the engine coolant.

5. A method according to claim 1, wherein said engine includes an air flow actuator coupled with the path of said intake air flow and step (d) comprises operating said air flow actuator so as to control said actual mass air flow rate.

6. A method according to claim 5, wherein said air flow is provided in an air flow bypass path that is coupled with the main path of said intake airflow and step (d) comprises operating said air flow actuator so as to adjust the air flow in said bypass path and thereby control said actual mass air flow rate.

7. A method according to claim 6, wherein said air flow bypass is disposed between an upstream portion and a downstream portion of a throttle valve for the air/fuel mixture supplied to said engine.

8. A method according to claim 6, wherein said air flow actuator comprises a double seat valve provided in said air flow bypass path.

9. A method according to claim 6, wherein said air flow actuator comprises a cock valve disposed in said air flow bypass path, the air flow controlling position of which is controlled by a stepping motor, and step (d) comprises operating said stepping motor to control the position of said cock valve in said air flow bypass path.

10. A method according to claim 5, wherein said air flow actuator comprises a throttle valve disposed in the main path of said intake air flow.

11. A method according to claim 10, wherein said prescribed state of closure corresponds to the fully closed state of said throttle valve.

12. A method according to claim 10, wherein said air flow actuator further comprises an ecentric cam coupled with a throttle lever attached to said valve, and a stepping motor for rotating said eccentric cam in accordance with a signal representative of said desired mass air flow rate determined in step (c).

13. A method according to claim 10, wherein said air flow actuator further comprises a rotatable threaded drive shaft drive by a stepping motor and coupled to a throttle lever attached to said throttle valve, said stepping motor being operating in accordance with a signal representative of said desired mass air flow rate determined in step (c).

14. A method according to claim 10, wherein said throttle valve has an opening into which an air flow restricting member is controllably positioned and step (d) comprises adjusting the degree of entry of said air flow restricting member into the opening of said throttle valve.

15. A method according to claim 1, wherein said air/fuel mixture is supplied to said engine under the control of a throttle valve and further comprising the step of:

(a) prior to steps (a)–(d), detecting whether said throttle valve is in a prescribed state of closure, and then carrying out steps (a)–(d) in response to detecting that said throttle valve is in said prescribed state of closure.

16. A method according to claim 15, wherein said at least one prescribed parameter corresponds to the temperature of the engine coolant and step (b) is carried out prior to step (e).

17. A method according to claim 16, further comprising the step of:

(f) controlling a fuel control actuator in accordance with the temperature of the engine coolant.

18. A method according to claim 1, further comprising the step of:

(e) controlling the amount of fuel in said air/fuel mixture in accordance with said at least one parameter measured in step (b).

19. A method according to claim 18, wherein said at least one prescribed parameter includes the temperature of the engine coolant.

* * * * *